United States Patent [19]

Angeloz et al.

[11] Patent Number: 4,982,880

[45] **Date of Patent: * Jan. 8, 1991**

[54] CONTAINER AND TEAT FEEDING ASSEMBLY

[75] Inventors: Corinne Angeloz, Thun; Peter Huerlimann; Rudolf Schmied, both of Konolfingen; Eugene Van Meir, Fribourg, all of Switzerland

[73] Assignee: Nestec S. A., Vevey, Switzerland

[ * ] Notice: The portion of the term of this patent subsequent to Jun. 5, 2007 has been disclaimed.

[21] Appl. No.: 403,614

[22] Filed: Sep. 6, 1989

Related U.S. Application Data

[63] Continuation-in-part of Ser. No. 281,086, Dec. 7, 1988, Pat. No. 4,930,690.

[30] Foreign Application Priority Data

Sep. 7, 1988 [EP] European Pat. Off. ..... 88114545.2

[51] Int. Cl.[5] ..... A61J 9/00

[52] U.S. Cl. ..... 222/490; 215/1 C; 215/11.1; 215/11.6; 222/568

[58] Field of Search ..... 215/11.1, 11.3, 11.6, 215/1 C, DIG. 6; 222/490, 566–568

[56] References Cited

U.S. PATENT DOCUMENTS

| | | | |
|---|---|---|---|
| 1,672,734 | 6/1928 | Reilly | 215/11.1 |
| 1,714,241 | 5/1929 | Reilly | 215/11.1 |
| 1,994,466 | 3/1935 | Erne | 222/568 X |
| 2,843,281 | 7/1958 | Gallois | 215/11.1 |
| 3,235,113 | 2/1966 | Seibert | 215/11.1 |
| 3,415,402 | 12/1968 | Webber | 215/DIG. 6 X |
| 3,746,198 | 7/1973 | Howland | 215/11.1 |
| 4,569,869 | 2/1986 | Kushida et al. | 215/1 C X |
| 4,678,092 | 7/1987 | Rane | 215/11.3 |

FOREIGN PATENT DOCUMENTS

| | | | |
|---|---|---|---|
| 776807 | 2/1935 | France | 215/11.1 |
| 83333 | 3/1954 | Norway | 222/490 |
| 185506 | 12/1955 | Sweden | 222/490 |
| 210375 | 1/1924 | United Kingdom | 215/11.6 |

*Primary Examiner*—Kevin P. Shaver
*Attorney, Agent, or Firm*—Vogt & O'Donnell

[57] ABSTRACT

A container and teat feeding assembly includes a locking ring which secures a base of the teat to a rim integral with the container which extends away from an open end of the container. At least three projections integral with the rim extend from an edge of the rim away from the container. A lid is peelably sealed to an upper surface of the rim and has a grip tab which facilitates removal of the lid from the rim. The locking ring has a lip which abuts an upper surface of the rim and has a groove which accommodates the base of the teat between it and the rim. The locking ring also has a skirt extending from the lip about the rim edge. The skirt has a recess which accommodates the rim projections, and lugs extend from the skirt to provide for locking engagement with the rim projections.

16 Claims, 3 Drawing Sheets

CONTAINER AND TEAT FEEDING ASSEMBLY

CROSS REFERENCE TO RELATED APPLICATION

This application is a continuation-in-part application of Application Ser. No. 07/281,086, filed Dec. 7, 1988, now U.S. Pat. No. 4,930,690.

BACKGROUND OF THE INVENTION

This invention relates to a feeding kit comprising a container, a teat and means for fixing the teat to the container.

There are already many known systems for feeding newborn babies and infants. The most widely used systems comprise containers of glass or injection-moulded plastic with a screwthread for holding the teat with the locking ring on the upper rim of the container. These feeding systems are extremely onerous, above all when they are nonreuseable, as in hospitals.

SUMMARY OF THE INVENTION

The object of the present invention is to provide an inexpensive feeding kit in which the container does not have a screwthread.

The present invention relates to a feeding kit comprising a container, a teat and means for fixing the teat to the container, in which the container is thermoformed or injection-moulded, comprises a lateral wall reinforced by a cover foil, the upper rim of the container comprising at least three projections cooperating with the teat fixing means, said fixing means being formed by a locking ring comprising an upper lip and a circular lateral skirt internally comprising at least three holding lugs.

DETAILED DESCRIPTION OF THE INVENTION

As illustrated in the drawing Figures further described below, the container and teat feeding assembly of the present invention includes three cooperating elements, that is, the container having a rim about an open end, a teat and a locking ring.

The container has a base integral with lateral walls reinforced with a cover foil extending from the base to an edge defining an upper open end. A rim having upper and lower surfaces is integral with and extends to a rim edge away from the open end edge of the lateral walls in a plane parallel with a plane of the open end of the container defined by the edge of the lateral walls. At least three projections integral with the rim extend from the rim edge away from the open end.

A lid for covering the open end of the container is peelably sealed to the upper surface of the rim and has a grip tab which facilitates removal of the lid from the rim.

The test encompasses the open end of the container and has a base which is configured to be seated on the rim.

The locking ring is configured to encompass the base of the teat about the open end of the container and to accommodate the rim and its projections. The locking ring has a lip which abuts the upper rim surface and extends from the open end edge beyond the rim edge away from the open end and has a groove at the open end edge for accommodating and securing the base of the teat within the groove between the lip and the upper surface of the rim. A ring skirt integral with the lip extends from the lip edge about the rim edge and has a recess for accommodating the rim projections. Lugs integral with the skirt corresponding in number with the number of projections extend perpendicularly from the skirt towards the lateral walls and are configured and positioned for, together with the recess, locking engagement with the rim projections.

The cover foil is made of a material selected from aluminium, paper, a paper/aluminium composite and a plastics material, such as polystyrene. The lateral wall is reinforced by thermal welding of the foil during the thermoforming or injection moulding of the container of the feeding kit of the present invention.

Thermoforming of the container is carried out using the machine according to FR-PS 2 034 915. The presence of the cover foil on the lateral wall of the container provides for strengthening of the kit. This foil is necessary for ensuring firm holding of the container and avoids any breakage in use.

To ensure maximum fluid-tightness of the feeding kit, the container comprises between 3 and 6 projections cooperating with 3 to 6 corresponding holding lugs of the locking ring.

The feeding kit according to the invention may be used several times although it is preferably non-reuseable the container comprising a peelable lid and holding the liquid to be administered.

The container may be filled in two different ways. Either the thermoformed container is sterilized, passed along an aseptic filling line and sealed or the container is filled, sealed and the whole is sterilized. For use, the lid merely has to be removed and the container capped with the locking ring and the teat.

The feeding kit according to the invention may also be supplied sterile and empty and may be filled by hand just before use.

The locking ring is made separately and may be reused several times. The kit according to the invention is intended for use above all in hospitals and the liquid used is hypoallergenic milk. However, any other type of liquid for infants, newborn or premature babies may also be used.

One of the projections on the upper rim of the container which projects beyond the locking ring is provided to facilitate peeling of the lid in use. The lid is thus easy to remove.

The material used for the body of the container is selected from polypropylene, polyethylene, polyester, polyamide, polycarbonate and polyvinyl chloride in cases where the container with its contents is heat-treated, for example by post-sterilization. The container is either single-layer or multi-layer, in which case the combination polypropylene/EVOH/polypropylene would be suitable. The EVOH (ethylene/vinyl alcohol copolymer) layer may be replaced by any other layer capable of forming an oxygen barrier, for example polyvinylidene chloride. If the container is filled aseptically, the range of plastics may be extended to include polystrates and copolymers thereof.

Since the material used for the body of the container is normally transparent, the cover foil which is usually opaque may advantageously leave a slot, for example a vertical slot, in the side wall through which the liquid level in the container may be observed.

The pealable lid is normally an aluminium foil sealed to the upper rim of the container by welding. Multilayer covers are also suitable, for example in the form of films of plastics materials combined with aluminium foils, such as aluminium/polyester/polyethylene.

In the interests of safety during opening, for example to avoid splashing during removal of the actual cover, a plastics film is provided beneath the lid, remaining sealed to the upper rim of the container and comprising a central opening so that a circular border approximately 5 mm wide is formed towards the interior of the container. The liquid product accommodated in the container is thus unable to overflow in the event of over-vigorous opening. This plastics film is preferably made of polyester.

In this preferred embodiment of the feeding kit according to the invention, the film must of course remain on the container during removal of the lid . However, in this and in the other embodiments disclosed above removal of the lid must be able to be started despite the fact that, when applied to the container, it was heat-sealed thereto. To this end, the grip tab of the lid is subjected after heat-sealing of the lid and after cutting of the container to partial separation at the place where the lid is initially gripped, for example by relative enlargement of the membrane and foil at this point to facilitate welding of the aluminium complex to the membrane. This operation may be carried out by any means capable of producing such an enlargement, such as a punch, for example with a knurled surface, applied to the upper surface of the grip tab and producing an embossed effect. Alternatively, the tab may be nipped between two rollers having substantially horizontal axes, the upper roller being knurled. In another variant, the partial separation may be obtained by creating an imprint of any, for example trapezoidal, outline. Finally, the centre of the upper part of the grip tab may be stamped and compressed air may be blown in at the cut.

Where an imprint is formed, the punch may be formed, for example, with a relief, thus ensuring a more pronounced imprint towards both the outside and the inside of the tab. Similarly, the axis of the upper roller may be slightly inclined relative to the axis of the lower roller, thereby ensuring more pronounced nipping towards the outside of the tab.

BRIEF DESCRIPTION OF THE DRAWINGS

The feeding kit according to the invention is described in more detail in the following with reference to the accompanying-drawings.

DETAILED DESCRIPTION OF THE DRAWINGS

On its upper rim (4), the container (1) comprises four projections (2) and fifth projection (3) larger in size additionally provided for peeling off the lid (not shown).

Figure 1:
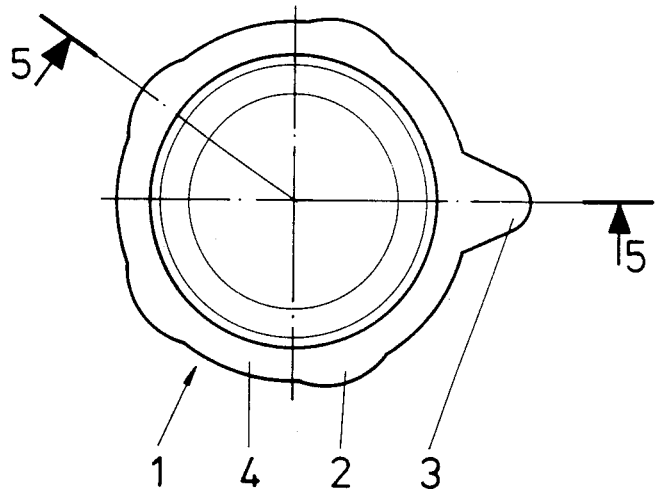
FIG. 1 is a plan view of the container of the feeding kit.
Figure 2:
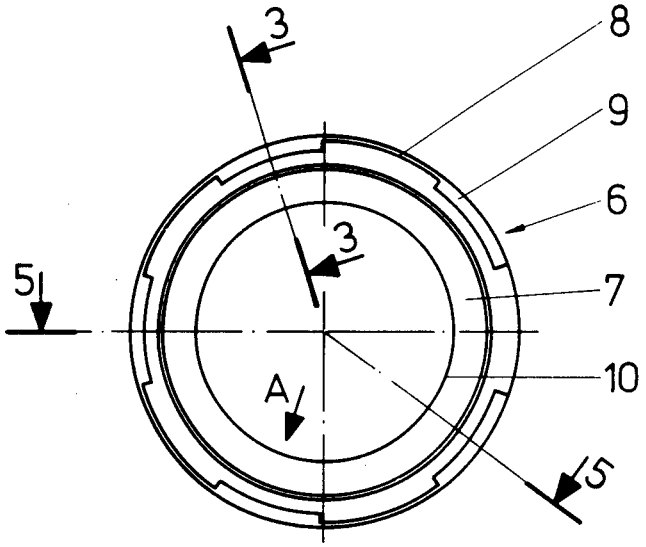
FIG. 2 is a view of the locking ring from beneath.
Figure 3:
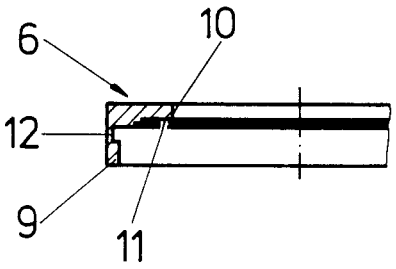
FIG. 3 is a section on the line 3—3 in FIG. 2.

FIG. 2 shows the locking ring (6) comprising an upper lip (7) and a lateral skirt (8). Five holding lugs (9) are arranged inside the skirt. The teat is held in the groove (11) along the edge (10) as further shown in FIG. 3. The projection (2) of the upper rim of the container engages in the recess (12) as also shown in FIG. 3.

Figure 4:
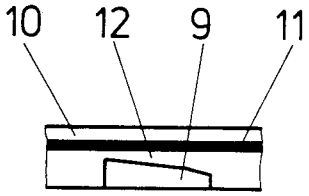
FIG. 4 is a view inside the locking ring in the direction of arrow A.

FIG. 4 clearly shows the configuration of the holding lug (9).

Figure 5:
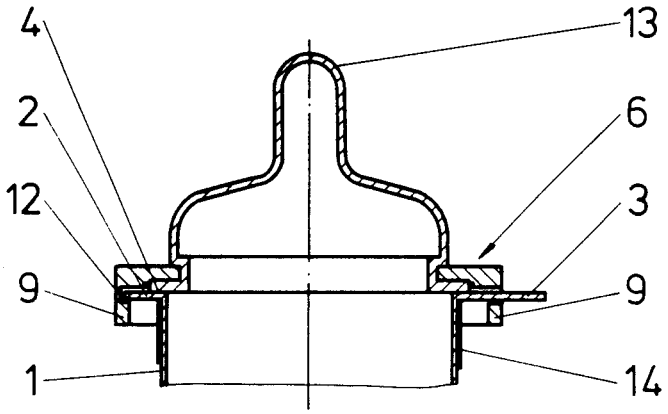
FIG. 5 is a section on the line 5—5 of FIGS. 1 and 2, the locking ring and the teat being in position on the container.

FIG. 5 shows a feeding kit ready for use, i.e., from which the lid has been removed. The teat (13) is engaged on the locking ring (6). This ring and teat combination is then applied to the upper rim (4) of the container (1) comprising a reinforcing foil (14) of aluminium and the ring is turned so that the holding lugs (9) lock the projections (2) and (3) in the recess (12). This provides a system for holding the teat which is perfectly leak-proof with no screwthread on the container. The reinforcing foil (14) delimits a slot (15) through which the liquid level in the container may be observed.

Figure 6:
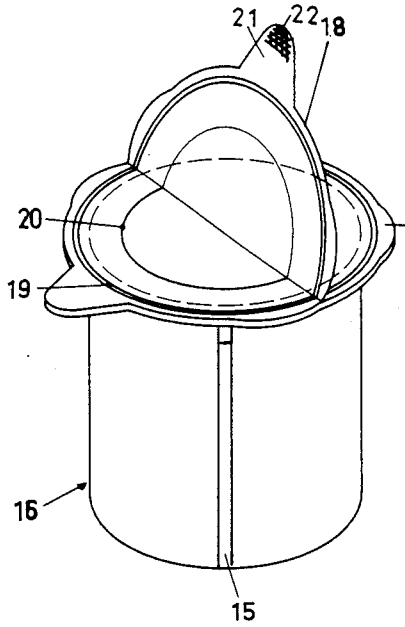
FIG. 6 is a perspective view of the container comprising a film of plastics material.
Figure 7:
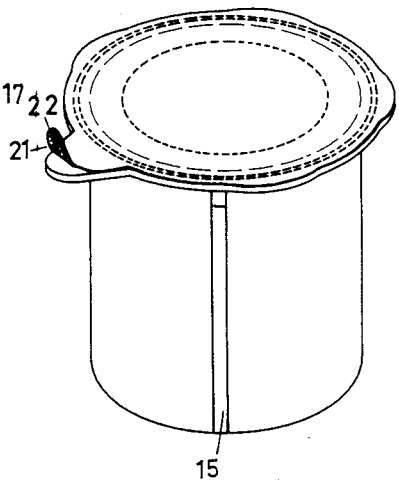
FIG. 7 is a perspective view showing the beginning of removal of the lid.

An annular boss is advantageously provided in the groove (11) of the locking ring (6) opposite the teat (13), engaging in a corresponding annular groove in the teat. This configuration provides for better fixing of the teat and for effective fluid-tightness of the system. FIGS. 6 and 7 show the container (15) of the feeding kit in a second embodiment. Beneath the pealable lid (18), the upper rim (17) comprises a film (19) of plastics material with a central opening (20). For use, the lid (18) is removed by the grip tab (21), of which the open part (22) is embossed, and the locking ring complete with the teat is applied to the upper rim (17). The presence of the film (19) thus avoids any risk of splashing in the event of over-vigorous handling.

The thermoforming of the container provides for a lowcost system. The container accommodating the liquid is non-reuseable whereas the locking ring and the teat may be reused.

We claim:

1. A container and teat feeding assembly comprising:

a container having:

(i) a base integral with lateral walls reinforced with a cover foil extending from the base to an edge defining an upper open end;

(ii) a rim integral with and having upper and lower surfaces extending to a rim edge away from the open end edge of the lateral walls in a plane parallel with a plane of the open end of the container defined by the edge of the lateral walls;

(iii) at least three projections integral with the rim extending from the rim edge away from the open end wherein one of the projections extends from the rim edge away from the open end beyond the other projections; and (iv) a lid for covering the open end of the container peelably sealed to the upper surface of the rim and having a grip tab extending from the lid and being positioned for communication with and partly separated from an upper surface of the projection which extends beyond the other projections;

a teat having a base seated on the rim of the container; and a locking ring having:

(i) a ring lip abutting an upper surface of the lid about the upper surface of the rim extending from the open end edge to a lip edge beyond the rim edge away from the open end and having a groove at the open end edge from accommodating and securing the base of the teat within the groove between the lip and the upper surface of the lid about the rim;

(ii) a ring skirt integral with and extending perpendicularly from the lip edge about the rim edge and having a recess from accommodating the rim projections; and (iii) lugs integral with and extending perpendicularly from the skirt towards the lateral walls corresponding in number with the container rim projections and configured and positioned for, together with the recess, locking engagement with the rim projections.

2. A feeding assembly according to claim 1 wherein the rim further comprises a film extending from the upper surface of the rim to within the open end for forming a border extending from the rim about the container open end.

3. A feeding assembly according to claim 1 wherein an outer part of the grip tab extending away from the lid is embossed.

4. A feeding assembly according to claim 1 wherein the lip further comprises an annular boss adjacent the teat further defining the lip groove and the teat further comprises an annular groove, the boss and annular teat groove being positioned for engagement with each other.

5. A feeding assembly according to claim 1 wherein the cover foil of the lateral walls defines a slot through which the lateral walls of the container are visible.

6. A feeding assembly according to claim 1 wherein the container is made from a material selected from a group consisting of polypropylene, polyethylene, polyester, polyamide, polycarbonate, polyvinylidene chloride, polyvinyl chloride, polystyrene and copolymers thereof and combinations thereof, EVOH and wherein the cover foil is made from a material selected from a group consisting of aluminum, paper, paper/aluminum composite and polystyrene.

7. A feeding assembly according to claim 1 wherein the lid is made from a material selected from a group consisting of aluminum foil and multi-layers of plastic films combined with aluminum foils.

8. A feeding assembly according to claim 7 wherein the plastic films are made from polyester and polyethylene.

9. A container and teat feeding assembly fit comprising:

a container having:

(i) a base integral with lateral walls reinforced with a cover foil extending from the base to an edge defining an upper open end;

(ii) a rim integral with and having upper and lower surfaces extending to a rim edge away from the open end edge of the lateral walls in a plane parallel with a plane of the open end of the container defined by the edge of the lateral walls;

(iii) at least three projections integral with the rim extending from the rim edge away from the open end wherein one of the projections extends from the rim edge away from the open end beyond the other projections; and (iv) a lid for covering the open end of the container peelably sealed to the upper surface of the rim and having a grip tab extending from the lid and being positioned for communication with and partly separated from an upper surface of the projection which extends beyond the other projections;

a teat having a base for being seated on the rim of the container; and a locking ring having:

(i) a ring lip for abutting the upper rim surface and extending from the open end edge to a lip edge beyond the rim edge away from the open end and having a groove at the open end edge from accommodating and securing the base of the teat within the groove between the lip and the upper surface of the rim;

(ii) a ring skirt integral with and extending perpendicularly from the lip edge about the rim edge and having a recess for accommodating the rim projections; and (iii) lugs integral with and extending perpendicularly from the skirt towards the lateral walls corresponding in number with the container rim projections configured and positioned for, together with the recess, locking engagement with the rim projections.

10. A feeding kit according to claim 9, wherein the rim further comprises a film extending from the upper surface of the rim to within the open end for forming a border extending from the rim about the container open end.

11. A feeding kit according to claim 9 wherein an outer part of the grip tab extending away from the lid is embossed.

12. A feeding kit according to claim 9 wherein the lip further comprises an annular boss adjacent the teat further defining the lip groove and the teat further comprises an annular groove, the boss and annular teat groove being positioned for engagement with each other.

13. A feeding kit according to claim 9 wherein the cover foil of the lateral walls defining a slot through which the lateral walls of the container are visible.

14. A feeding kit according to claim 9 wherein the container is made from a material selected from a group consisting of polypropylene, polyethylene, polyester, polyamide, polycarbonate, polyvinylidene chloride, polyvinyl chloride, polystyrene and copolymers thereof and combinations thereof, EVOH and wherein the cover foil is made from a material selected from a group consisting of aluminum, paper, paper/aluminum composite and polystyrene.

15. A feeding kit according to claim 9 wherein the lid is made from a material selected from a group consisting of aluminum foil and multi-layers of plastic film combined with aluminum foils.

16. A feeding kit according to claim 15 wherein the plastic films are made from polyester and polyethylene.

* * * * *

UNITED STATES PATENT AND TRADEMARK OFFICE

CERTIFICATE OF CORRECTION

PATENT NO. : 4,982,880

DATED : January 8, 1991

INVENTOR(S) : Corinne ANGELOZ, et al.

It is certified that error appears in the above-identified patent and that said Letters Patent is hereby corrected as shown below:

Column 1, line 57, "test" should read --teat--.

Column 2, line 14, after "container" insert --of the feeding kit of the present invention--.

Column 2, line 30, after "sealed" insert a comma.

Column 3, line 16, after "above" insert a comma.

Column 3, line 44, the heading "BRIEF DESCRIPTION OF THE DRAWINGS" should appear between lines 48 and 49.

Column 3, line 47, delete "in the following".

Column 3, line 48, delete the hyphen after "accompanying".

UNITED STATES PATENT AND TRADEMARK OFFICE

CERTIFICATE OF CORRECTION

PATENT NO. : 4,982,880

DATED : January 8, 1991

INVENTOR(S) : Corinne ANGELOZ, et al.

It is certified that error appears in the above-identified patent and that said Letters Patent is hereby corrected as shown below:

Column 5, line 1, [line 30 of claim 1], "from" should read --for--.

Column 5, line 7, [line 36 of claim 1], "from" should read --for--.

Column 5, line 49 [line 1 of claim 9], "fit" should read --kit--.

Column 6, line 16 [claim 9], "from" should read --for--.

Column 6, line 45 [line 2 of claim 13], "defining" should read --defines--.

UNITED STATES PATENT AND TRADEMARK OFFICE

CERTIFICATE OF CORRECTION

PATENT NO. : 4,982,880

DATED : January 8, 1991

INVENTOR(S) : Corinne ANGELOZ, et al.

It is certified that error appears in the above-identified patent and that said Letters Patent is hereby corrected as shown below:

Column 6, line 58 [line 3 of claim 15], "film" should read --films--.

Signed and Sealed this

Twelfth Day of May, 1992

*Attest:*

DOUGLAS B. COMER

*Attesting Officer*

*Acting Commissioner of Patents and Trademarks*